US009060605B2

(12) United States Patent
Gasser

(10) Patent No.: US 9,060,605 B2
(45) Date of Patent: Jun. 23, 2015

(54) DRAWER

(71) Applicant: Julius Blum GmbH, Hochst (AT)

(72) Inventor: Ingo Gasser, Hochst (AT)

(73) Assignee: JULIUS BLUM GMBH, Hochst (AT)

( * ) Notice: Subject to any disclaimer, the term of this patent is extended or adjusted under 35 U.S.C. 154(b) by 0 days.

(21) Appl. No.: 14/146,930

(22) Filed: Jan. 3, 2014

(65) Prior Publication Data

US 2014/0117828 A1 May 1, 2014

Related U.S. Application Data

(63) Continuation of application No. PCT/AT2012/000166, filed on Jun. 12, 2012.

(30) Foreign Application Priority Data

Jul. 7, 2011 (AT) ..... A 990/2011

(51) Int. Cl.
*A47B 88/00* (2006.01)
*A47B 88/04* (2006.01)

(52) U.S. Cl.
CPC ..... *A47B 88/0422* (2013.01); *A47B 88/0014* (2013.01); *A47B 88/0085* (2013.01); *A47B 2088/0007* (2013.01)

(58) Field of Classification Search
CPC ..... A47B 88/0014; A47B 88/0055; A47B 2088/0007; A47B 2088/0066; A47B 2088/0037; A47B 88/0044; A47B 88/0085; A47B 88/0051; A47B 88/0018; A47B 2210/02; A47B 88/04; A47B 88/0422; A47B 47/03
USPC ..... 312/330.1, 333, 334.1, 334.4, 334.5, 312/334.27, 334.32, 348.1, 348.2, 348.4, 312/334.7, 265.6, 265.5
See application file for complete search history.

(56) References Cited

U.S. PATENT DOCUMENTS 4,690,469 A 9/1987 Grass
4,804,239 A * 2/1989 Rock et al. ..... 312/265
(Continued)

FOREIGN PATENT DOCUMENTS

CN 1135864 11/1996
CN 100998465 7/2007
(Continued)

OTHER PUBLICATIONS

International Searc Report (ISR) issued Sep. 19, 2012 in International (PCT) Application No. PCT/AT2012/000166.
(Continued)

*Primary Examiner* — Daniel J Troy
*Assistant Examiner* — Hiwot Tefera
(74) *Attorney, Agent, or Firm* — Wenderoth, Lind & Ponack, L.L.P.

(57) ABSTRACT

A drawer includes a front panel, a lateral drawer wall, and an attachment element arranged at least partially over the drawer lateral wall. The attachment element is intended to be fastened to the front panel by a fitting body separate from the drawer lateral wall, and the fitting body includes at least one fixing point for fixing to the front panel and a recess for receiving the attachment element. After completed mounting of the fitting body on the front panel, the attachment element can be brought into the recess of the fitting body, and the attachment element can be brought into the recess of the fitting body and can subsequently be pivoted about a notional axis running substantially vertically in the mounting position.

11 Claims, 6 Drawing Sheets

(56) References Cited

U.S. PATENT DOCUMENTS

| | | | | | |
|---|---|---|---|---|---|
| 4,815,796 | A | * | 3/1989 | Rock et al. | 312/263 |
| 5,348,386 | A | * | 9/1994 | Grass | 312/348.2 |
| 5,419,630 | A | * | 5/1995 | Rock et al. | 312/334.4 |
| 5,466,061 | A | * | 11/1995 | Lautenschlager | 312/348.2 |
| 5,538,339 | A | * | 7/1996 | R ock et al. | 312/348.1 |
| 5,647,711 | A | * | 7/1997 | Berger | 411/400 |
| 5,690,405 | A | * | 11/1997 | Huber | 312/348.2 |
| 5,895,103 | A | * | 4/1999 | Huber | 312/348.4 |
| 5,971,516 | A | | 10/1999 | Huber | |
| 6,120,226 | A | * | 9/2000 | Egger et al. | 411/48 |
| 6,412,893 | B1 | * | 7/2002 | Muterthies et al. | 312/348.1 |
| 6,481,813 | B1 | * | 11/2002 | Muterthies et al. | 312/348.1 |
| 7,903,401 | B2 | * | 3/2011 | Lee et al. | 361/679.33 |
| 8,480,039 | B2 | * | 7/2013 | Chang | 248/27.1 |
| 2007/0159039 | A1 | | 7/2007 | Lam et al. | |
| 2008/0061665 | A1 | * | 3/2008 | Lautenschlager | 312/333 |
| 2011/0163647 | A1 | * | 7/2011 | Hartl | 312/334.7 |
| 2012/0133259 | A1 | * | 5/2012 | Babucke-Runte et al. | 312/330.1 |
| 2013/0293079 | A1 | * | 11/2013 | Haemmerle | 312/334.8 |

FOREIGN PATENT DOCUMENTS

| | | |
|---|---|---|
| CN | 201152306 | 11/2008 |
| DE | 201 10 531 | 11/2001 |
| DE | 203 04 159 | 5/2003 |
| DE | 20 2008 011 5 | 10/2009 |
| DE | 20 2008 009 3 | 12/2009 |
| DE | 20 2009 002 2 | 8/2010 |
| EP | 1 297 765 | 4/2003 |
| EP | 1 459 651 | 9/2004 |
| EP | 1 516 561 | 3/2005 |
| EP | 2 145 562 | 1/2010 |
| WO | 03/024274 | 3/2003 |
| WO | 2009/127467 | 10/2009 |
| WO | 2010/094532 | 8/2010 |
| WO | 2011/000751 | 1/2011 |

OTHER PUBLICATIONS

Austrian Patent Office Search Report (ASR) issued Apr. 2, 2012 in Austrian Patent Application No. A 990/2011.

Chinese Search Report (SR) issued Feb. 2, 2015 in foreign counterpart Chinese Patent Application No. 201280031504.9.

* cited by examiner

DRAWER

BACKGROUND OF THE INVENTION

The present invention concerns a drawer comprising a front panel, a drawer side wall and an attachment element at least partially arranged over the drawer side wall. The attachment element is to be fixed to the front panel by way of a fitment body separate from the drawer side wall, and the fitment body has at least one fixing location for fixing to the front panel and a recess for receiving the attachment element. The attachment element, after mounting of the fitment body has been effected to the front panel, can be introduced into the recess of the fitment body.

The invention further concerns an article of furniture comprising at least one drawer of the kind to be described.

The height of drawer side walls can be increased by the arrangement of attachment elements, and it is also possible to increase the effective accommodation volume of the drawer. The attachment elements can be formed, for example, by hollow profile members having a profile inside wall and a profile outside wall, or they can also be in the form of decorative, plate-shaped inserts made of glass, wood, metal, plastic or ceramic.

In a known drawer in accordance with DE 201 10 531 U1, an attachment frame member can be fixed to a drawer without the use of a tool. Provided for that purpose at the front end of the attachment frame member is spreader dowel which can firstly be inserted into a pre-drilled bore in the front panel and can then be spread open within that bore by a lateral pivotal movement of the attachment frame member. By a further pivotal movement of the attachment frame member, it is possible for a holding device arranged at the rear end region of the attachment frame member to be snap-engaged on to the drawer rear wall.

Drawers with plate-shaped attachment members which can also be subsequently inserted to a pre-assembled fitment body are described in EP 1 516 561 A1, WO 03/024274 A1, DE 20 2008 011 505 U1, U.S. Pat. No. 4,690,469, DE 20 2008 009 396 U1 and DE 20 2009 002 242 U1. A disadvantage with those structures is the large amount of space required for introducing the attachment members.

SUMMARY OF THE INVENTION

The object of the invention is to simplify the fitment of the attachment element to a drawer of the kind set forth in the opening part of this specification, while avoiding the above-mentioned disadvantage.

According to the invention, the attachment element can be introduced into the recess in the fitment body and is then pivotable about a notional axis extending substantially vertically in the mounting position.

In other words, after being introduced into the recess, the attachment element can be pivoted laterally in the direction of the center of the drawer body. The lateral pivotal movement of the attachment element therefore means that there is no need for an increased amount of space in the height direction. That is advantageous in particular when a plurality of drawers, when arranged above one another, are in an open position, in which case that drawer which is respectively disposed above the drawer with the attachment element to be mounted thereto does not impede fitment of the attachment element.

The drawer can be selectively provided with an attachment element, in particular also when the drawer front panel, the drawer side walls and the drawer rear wall are already assembled to provide a common structural unit. In that respect, a modular connection of the attachment element relative to the drawer and also dismantling which is easy to implement are possible without the necessity of dismantling the drawer.

The fitment body can firstly be secured to the rear side of the front panel by the provided fixing location, and the attachment element, after mounting of the fitment body, can then be introduced into the provided recess and fixed relative to the front panel. It is therefore not necessary for the drawer side wall and/or a railing to be provided with fixing means for the attachment element, as fitting or removal of the attachment element can be effected in a manner which is independent of those components.

The fitment body can have a structure comprising two or more parts, in which respect it is preferable that the fitment body has a fixing portion having the fixing location and a receiving portion having the recess, and the fixing portion can be releasably connected to the receiving portion. In that way, it is possible for the attachment element either to be introduced directly into the recess in the fitment body which is pre-fitted to the front panel, or alternatively it is also possible for the receiving portion to be firstly connected to the attachment element and only then for the receiving portion to be connected to the fixing portion of the fitment body, that is pre-fitted to the front panel. In that case, removal of the attachment element is possible at any time, wherein the fixing portion of the fitment body can remain constantly on the front panel.

An advantageous possible form of connection provides that the fixing portion and the receiving portion can be connected together, preferably releasably, by way of at least one snap-action connection.

The article of furniture according to the invention is characterised by at least one drawer of the kind in question.

BRIEF DESCRIPTION OF THE DRAWINGS

Further details and advantages of the present invention will be described by way of example illustrated in the drawings, in which.

DETAILED DESCRIPTION OF THE PRESENT INVENTION

Figure 1:
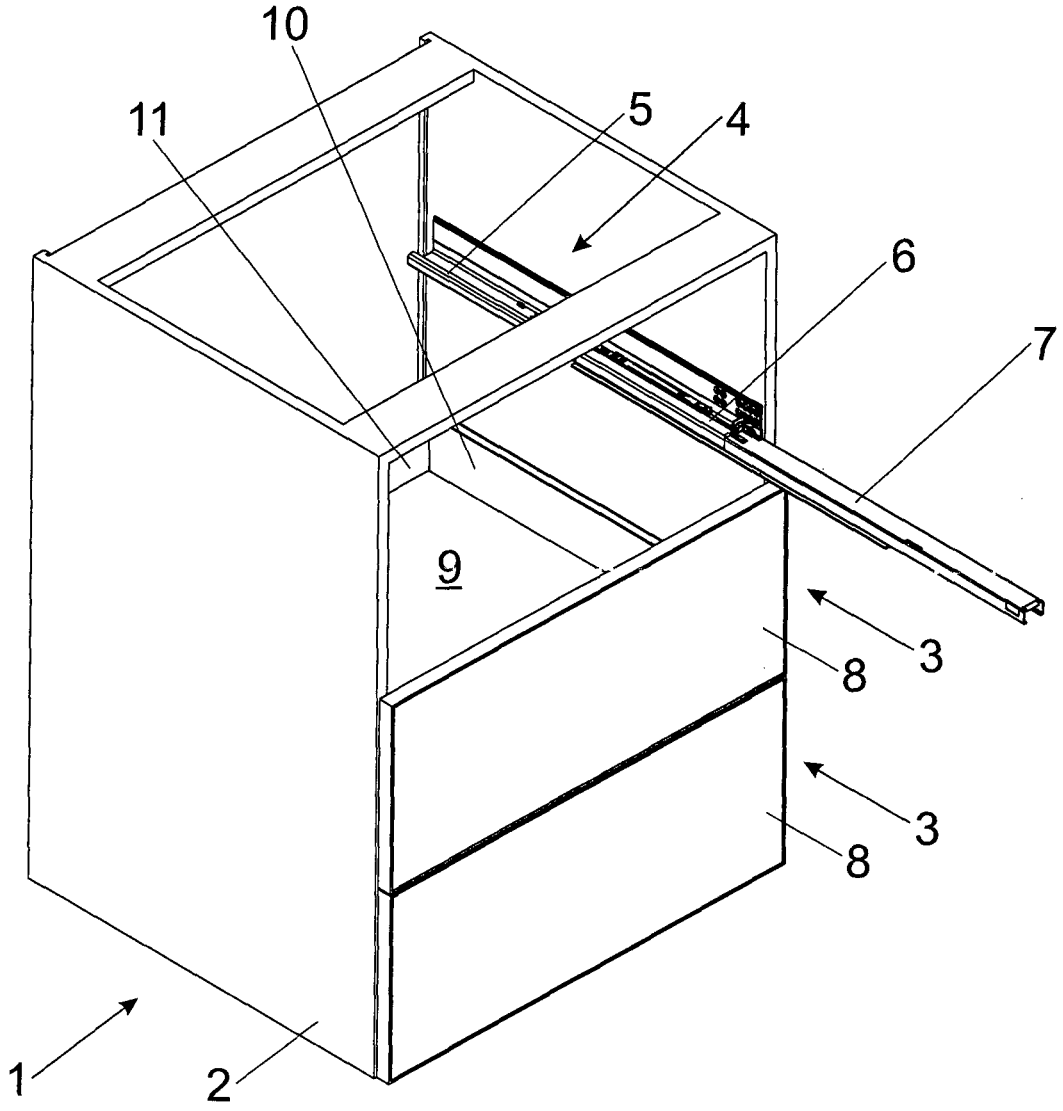
FIG. 1 is a perspective view of an article of furniture comprising a furniture carcass and displaceable drawers.

FIG. 1 shows a perspective view of an article of furniture 1. The article of furniture 1 has a plurality of drawers 3 mounted displaceably relative to a furniture carcass 2 in cabinet form by way of drawer extension guides 4. Each drawer extension guide 4 has in per se known manner a carcass rail 5 to be fixed to the furniture carcass 2, a drawer rail 7 to be fixed to the drawer 3 and a central rail 6 displaceable between the carcass rail 5 and the drawer rail 7. The drawers 3 each have a front panel 8, a drawer bottom 9, drawer side walls 10, and a rear wall 11.

Figure 2:
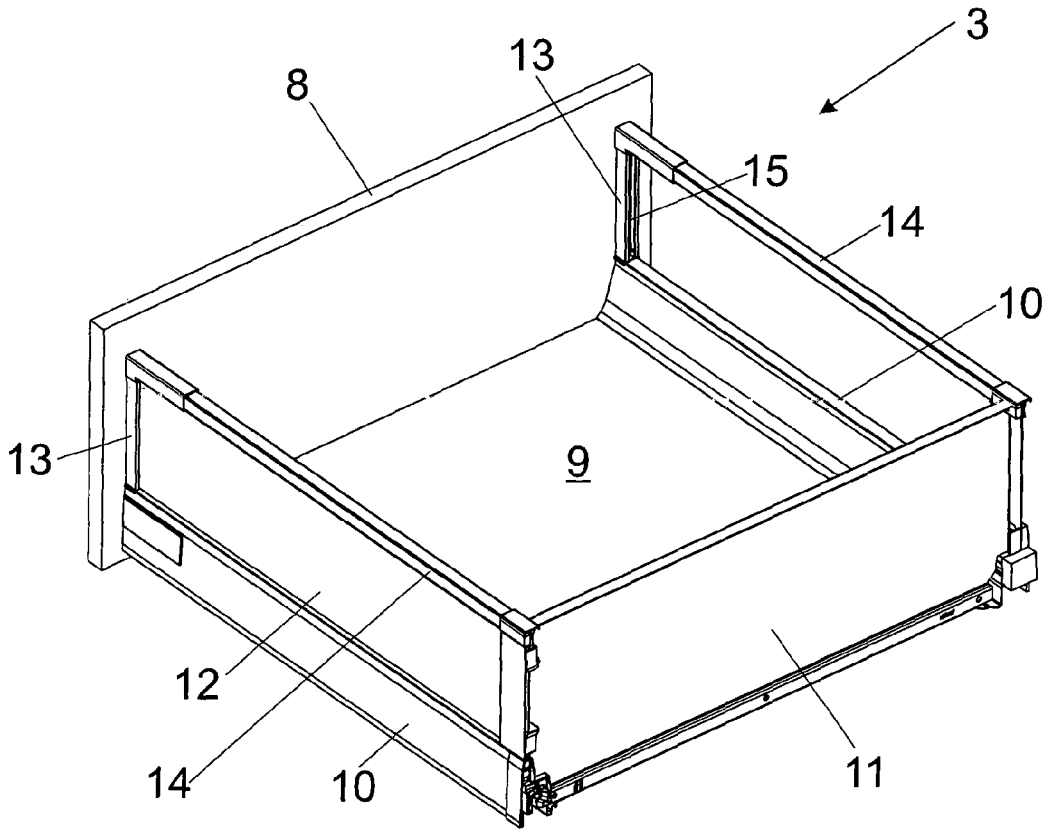
FIG. 2 is a perspective view of a drawer.

FIG. 2 shows a perspective view from the rear of a drawer 3. The drawer 3 includes a front panel 8, a drawer bottom 9, side walls 10 and a rear wall 11. Arranged above a side wall 10 is an attachment element 12 which, for example, can be in the form of a plate-shaped insert comprising glass, wood, metal, plastic or ceramic while the plate-shaped attachment element 12 on the opposite side wall 10 is not shown. A railing strut 14 can optionally be arranged over the attachment elements 12. The attachment element 12 can be fixed by fitment body 13 to be mounted to the rear side of the front panel 8, and the fitment body 13 has a recess 15 in the form of a vertically extending groove for receiving the front end of the attachment element 12.

FIGS. 3*a*-3*d* show mounting of the attachment element 12 on a prefabricated drawer 3. The attachment element 12 is inserted from the side inclinedly into the recess 15 in the fitment body 13, in which respect the recess 15 have of a funnel-shaped (tapered) configuration for more easily introducing the attachment element 12. The fitment body 13 with the recess 15 is supported, preferably loosely, on the top side of the side wall 10, but it can also embrace the upper longitudinal edge of the side wall 10 in clamping engagement and/or in a positively locking relationship.

Figure 3A:
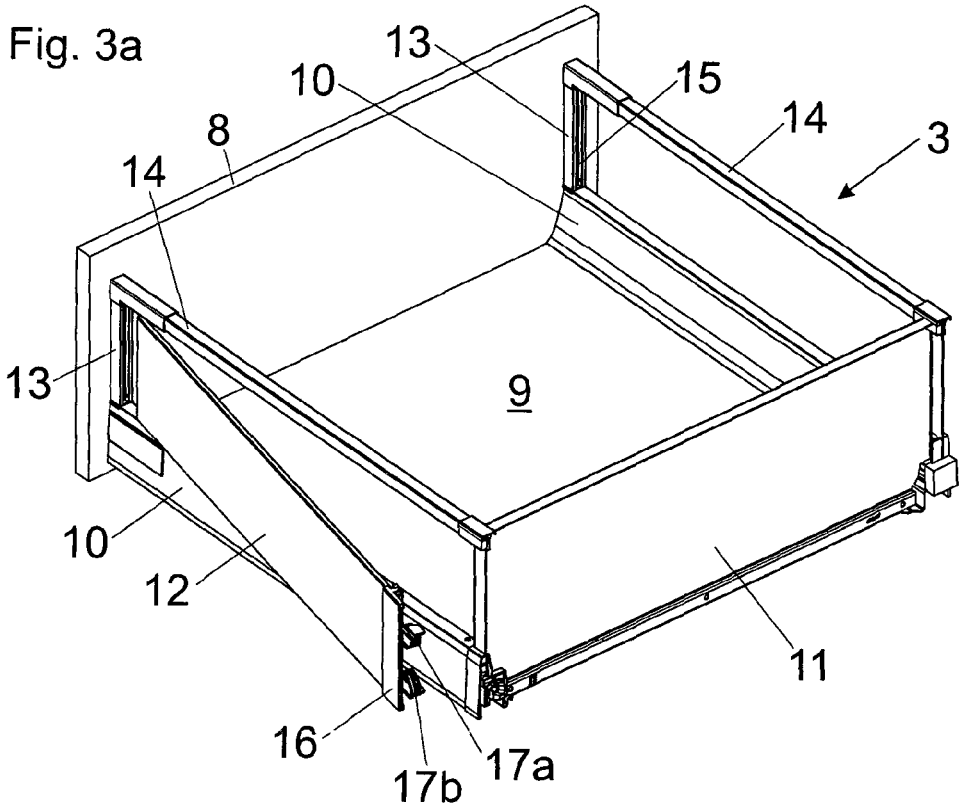
FIGS. 3*a*-3*d* show mounting of the attachment element to a drawer in mounting steps which occur in succession in time.
Figure 3B:
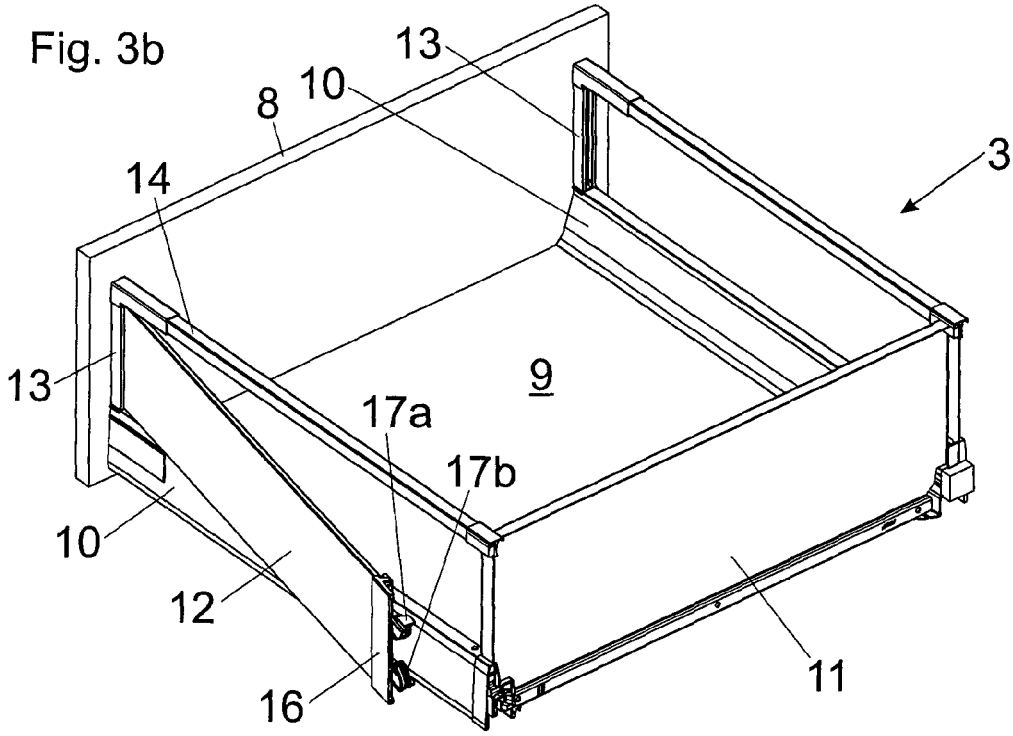

In FIG. 3*b* the attachment element 12 is disposed within the recess 15 in the fitment body 13. Mounted at the rearward end of the attachment element 12 is a fixing device 16 by which the attachment element 12 is to be fixed relative to the rear wall 11. After the attachment element 12 is introduced into the recess 15 in the fitment body 13, the attachment element 12 can be pivoted in the direction of the side wall 10 about a notional axis which in the mounting position extends substantially vertically (i.e., in a height-wise direction of the front panel 8).

Figure 3C:
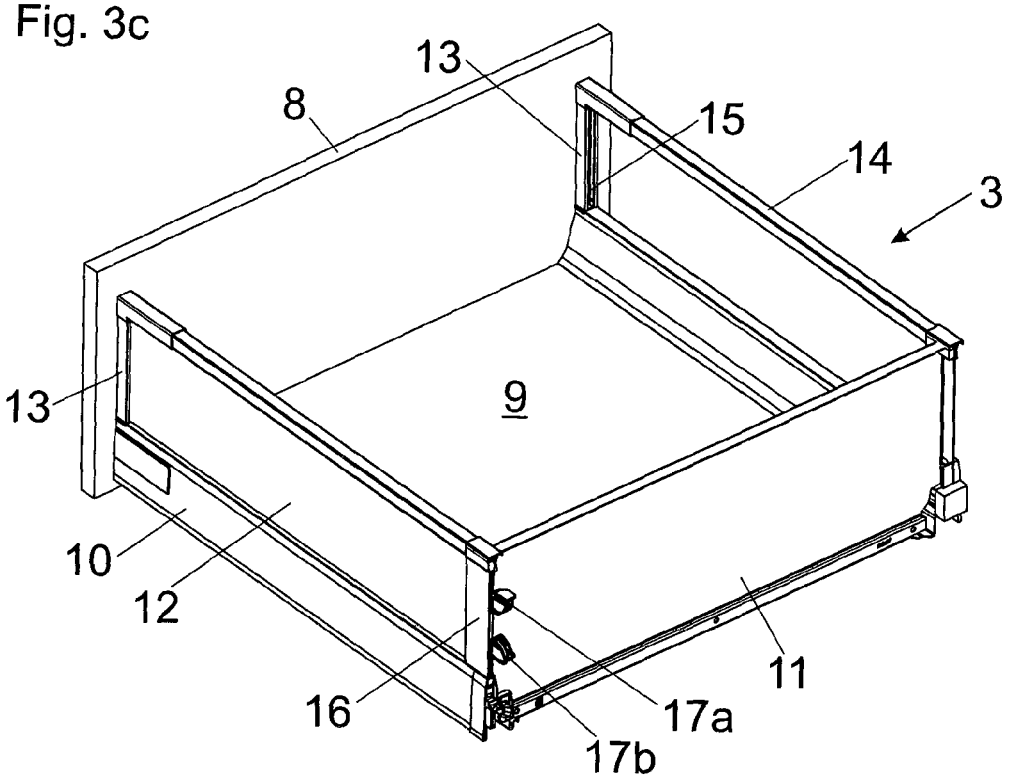
Figure 3D:
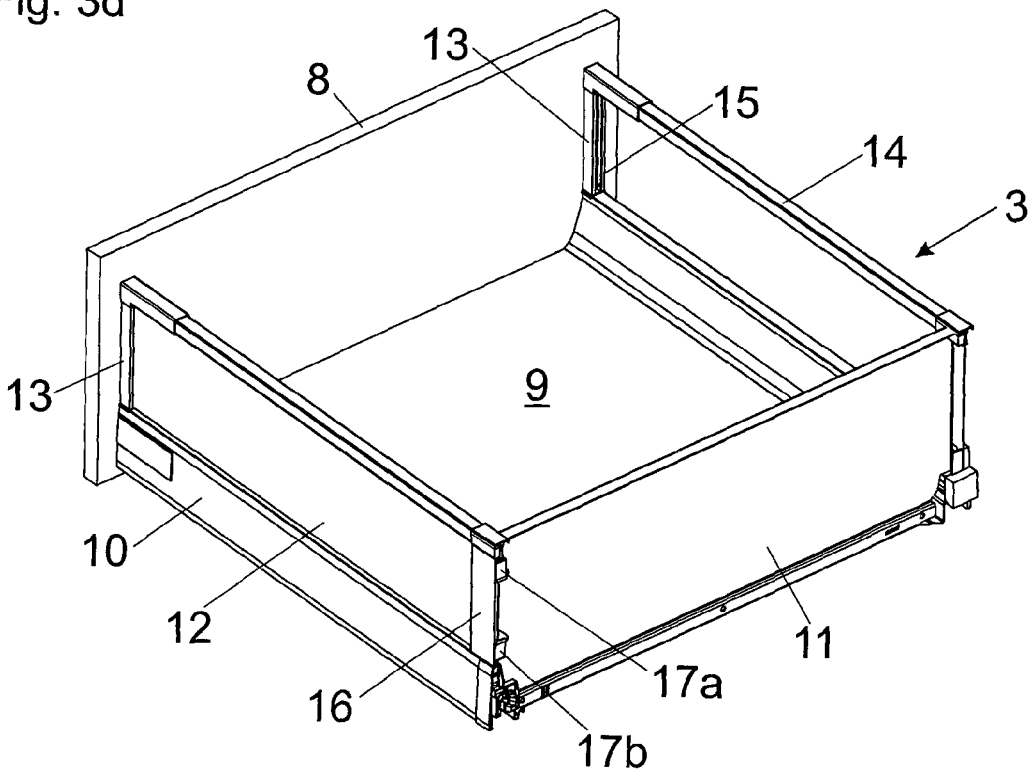

By virtue of a further pivotal movement of the attachment element 12 in the direction of the center of the drawer box, the attachment element 12 can assume a position as shown in FIG. 3*c*. In the illustrated embodiment, the fixing device 16 has two grip elements 17*a* and 17*b* which are to be actuated manually and which in an arresting position fix the attachment element 12 relative to the rear wall 11 in a positively locking and/or force-locking relationship and which in a release position release the attachment element 12 relative to the rear wall 11. The attachment element 12 can be fixed, as shown in FIG. 3*d*, by a pivotal movement of the upper grip element 17*a* upwardly and by a pivotal movement of the lower grip element 17*b* downwardly.

Figure 4B:
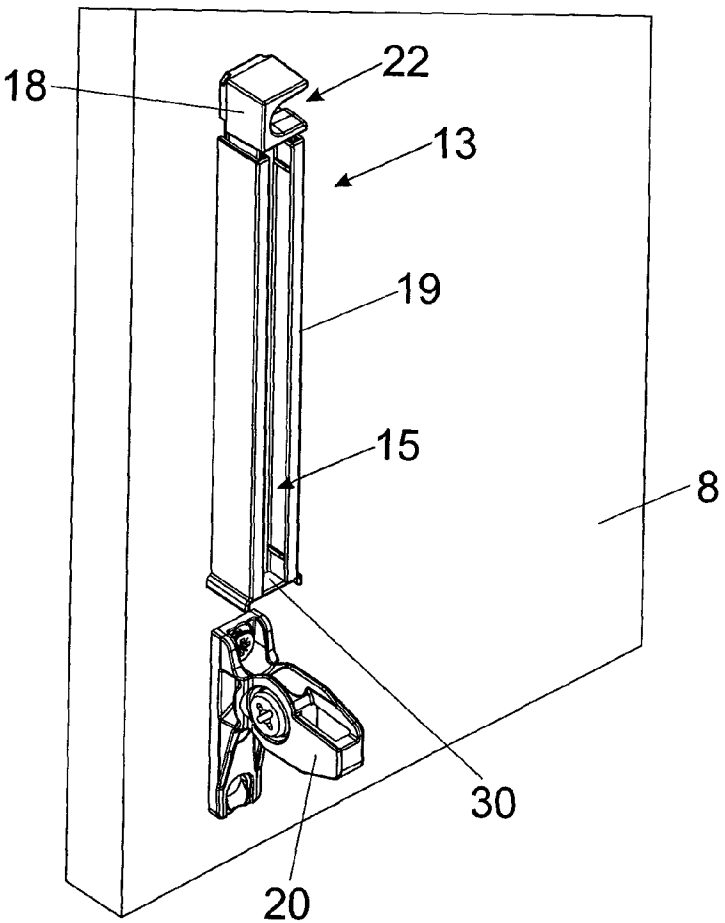
FIGS. 4*a*, 4*b* show the rear side of the front panel with the two-part fitment body to be mounted thereto in an exploded view and in the latched condition thereof.
Figure 4A:
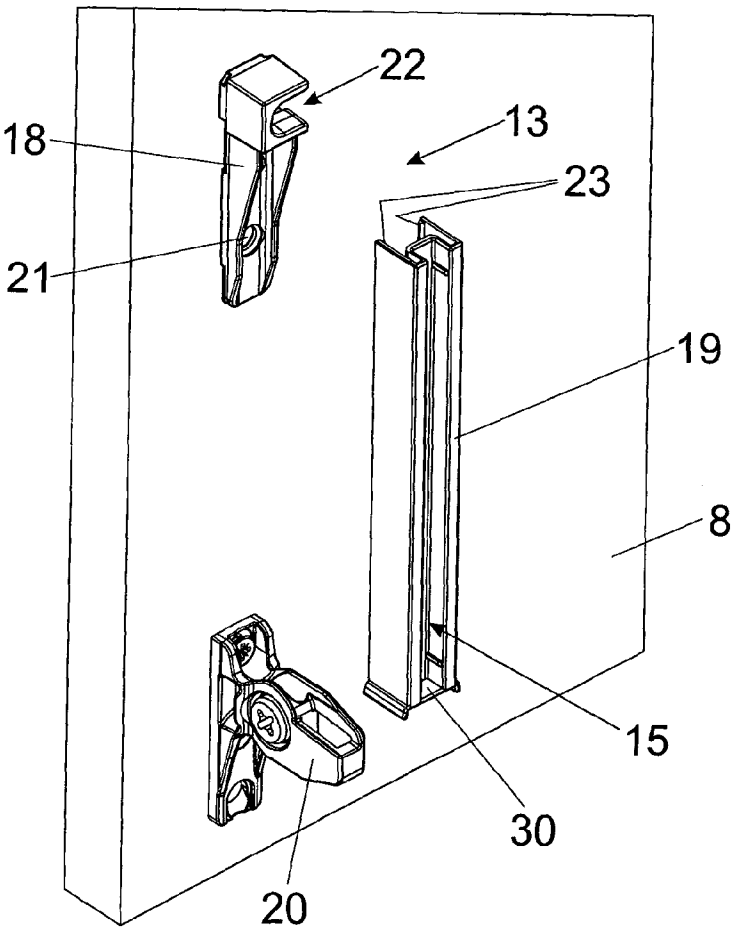

FIG. 4*a* shows the rear side of the front panel 8 to which the fitment body 13 is to be fitted. In the illustrated embodiment, the fitment body 13 has a two-part structure and includes a fixing portion 18 which is to be connected to the front panel 8 by way of at least one fixing location 21. In the illustrated Figure, the fixing location 21 is in the form of a bore provided for the passage of a screw which penetrates into the front panel 8. The fixing portion 18 further includes a device 22 for fixing the railing strut 14 which can be clampingly fixed in the device 22. The second part of the fitment body 13 forms a receiving portion 19 on which the recess 15 is provided for receiving the front end of the attachment element 12. The recess 15 is in the form of a groove which has a U-shaped cross-section and which is wider than the thickness of the attachment element 12. The length of the recess 15 substantially corresponds to the height of the attachment element 12. The receiving portion 19 can be latched to the fixing portion 18, wherein provided for that purpose on the receiving portion 19 are projections 23 which in the latched position engage behind the fixing portion 18 mounted to the front panel 8. The fitment body 13, preferably the receiving portion 19, has a support portion 30 at which the underside of the attachment element 12 can be supported. Thus, the attachment element 12 is loosely fit and removably held within the receiving portion 19 of the fitment body 13.

FIG. 4*b* shows the latched position between the receiving portion 19 and the fixing portion 18. Fixed to the front panel 8—as is known per se—is a holding portion 20 which can be introduced into the front end of the drawer side wall 10 and which can be releasably latched there with a locking mechanism which is known from the state of the art.

Figure 5A:
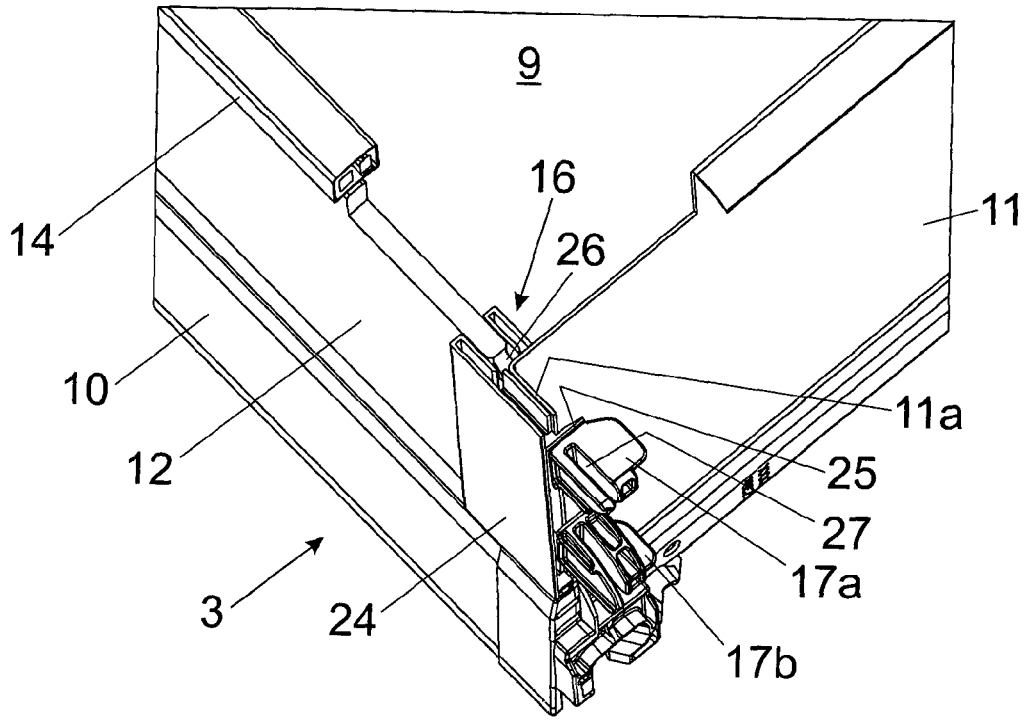
FIGS. 5*a*, 5*b* show a perspective and partly broken-away view of the rearward end region of the drawer.
Figure 5B:
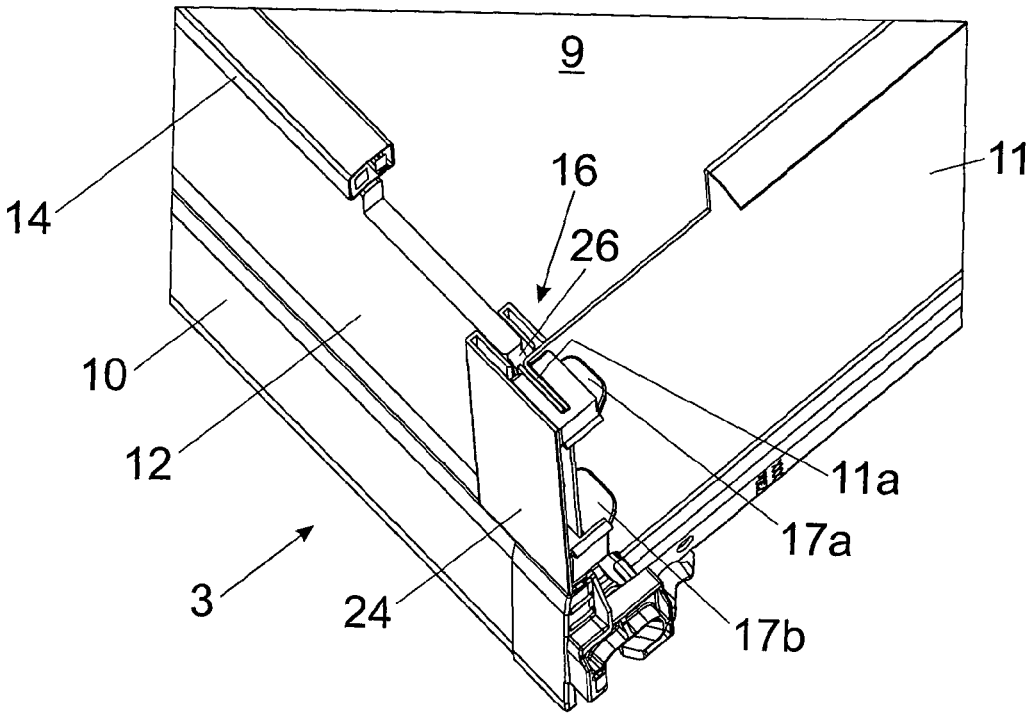

FIG. 5*a* shows a perspective and partly broken-away view of the rearward end region of the drawer 3. It is possible to see the drawer bottom 9, the side wall 10 and the rear wall 11 which has a rearwardly bent limb 11*a*. That limb 11*a* on the rear wall 11 cooperates with the fixing device 16 which is supported at the rearward end of the attachment element 12. The fixing device 16 includes a main body 24 provided with an insertion opening 26 for receiving the attachment element 12. The two grip elements 17*a* and 17*b* are pivotably connected to the main body 24 by way of a respective film hinge 25, wherein the pivot axis of the film hinge 25 extends preferably substantially horizontally in the position of use. The two grip elements 17*a* and 17*b* each have a receiving slot 27 which in the arresting position (FIG. 5*b*) receives the rearwardly bent limb 11*a* of the rear wall 11. FIG. 5*a* therefore shows the release position of the grip elements 17*a* and 17*b* in which the attachment element 12 can be removed from the drawer 3. FIG. 5*b* in contrast shows the arresting position of the grip elements 17*a* and 17*b*, wherein the attachment element 12 is fixed relative to the drawer 3. Fitting and/or removal of the attachment element 12 can therefore be effected without a tool, that is to say by hand, and without the necessary use of a tool. The fixing device 16 can be formed in its entirety in one piece from plastic, which is possible without any problem by an injection molding process.

The present invention does not relate just to the illustrated embodiment, but embraces or extends to all variants and technical equivalents which can fall within the scope of the claims hereinafter. The positional references adopted in the description such as for example up, down, lateral and so forth are also related to the directly described and illustrated Figure and are to be appropriately transferred to the new position upon a change in position. The attachment element 12 is preferably in the form of a rectangular block insert (preferably of a thickness of between 8 mm and 15 mm). In addition, it is possible for the rearward end of the attachment element 12 firstly to be fixed to the rear wall 11 by way of the fixing device 16, and only then for the front end of the attachment element 12 to be connected to the fitment body 13 mounted to the front panel 8. For that purpose, the fitment body 13 can also have a pivotably mounted closure cap by which the attachment element 12 can be fixed after being introduced into the recess 15 in the fitment body 13.

The invention claimed is:

1. A drawer comprising:

a front panel;

a drawer side wall;

an attachment element arranged at least partially over said drawer side wall;

a fitment body separate from said drawer side wall for fixing said attachment element to said front panel, said fitment body having:

a fixing location for fixing said fitment body to said front panel; and a recess formed as a groove having a U-shaped cross section for loosely receiving and removably holding said attachment element, said groove having a width wider than a thickness of said attachment element and having a length corresponding to a height of said attachment element; and a rear wall and a fixing device arranged at a rear end of said attachment element for fixing said attachment element to said rear wall;

wherein said attachment element is configured to be introduced into said recess of said fitment body after mounting of said fitment body to said front panel;

wherein said attachment element and said fitment body are configured to allow said attachment element to pivot about a notional axis extending in a height-wise direction of said front panel while being loosely received and removably held in said recess of said fitment body;

wherein said fitment body has a fixing portion having said fixing location and a receiving portion having said recess, said fixing portion configured to be releasably connected to said receiving portion;

wherein said fixing device has a main body with a grip element to be actuated manually, said grip element being configured to fix said attachment element in a locking relationship to said rear wall in an arresting position, and said grip element being configured to release said attachment element from said rear wall in a release position; and wherein said main body has an insertion opening for receiving said rear end of said attachment element.

2. The drawer according to claim 1, wherein said fixing portion and said receiving portion are configured to be releasably connected together by a one-snap connection.

3. The drawer according to claim 1, wherein said receiving portion loosely bears on a top side of said drawer side wall.

4. The drawer according to claim 1, wherein said attachment element is formed as a plate-shaped insert composed of at least one of glass, wood, metal, plastic, and ceramic.

5. The drawer according to claim 1, wherein said grip element has a receiving slot configured to receive a limb of said rear wall in the arresting position, said limb projecting from said rear wall.

6. The drawer according to claim 1, wherein said insertion opening is a groove.

7. The drawer according to claim 1, wherein said fixing device comprises a first fixing device, said fitment body having a second fixing device for fixing a railing strut thereto.

8. The drawer according to claim 7, further comprising a railing strut mounted along said attachment element, said attachment element being configured to be introduced into and removed from said recess of said fitment body when said railing strut is mounted.

9. An article of furniture comprising at least one drawer according to claim 1.

10. A drawer comprising:

a front panel;

a drawer side wall;

an attachment element arranged at least partially over said drawer side wall;

a fitment body separate from said drawer side wall for fixing said attachment element to said front panel, said fitment body having:

a fixing location for fixing said fitment body to said front panel; and a recess formed as a groove having a U-shaped cross section for loosely receiving and removably holding said attachment element, said groove having a width wider than a thickness of said attachment element and having a length corresponding to a height of said attachment element; and a rear wall and a fixing device arranged at a rear end of said attachment element for fixing said attachment element to said rear wall;

wherein said attachment element is configured to be introduced into said recess of said fitment body after mounting of said fitment body to said front panel;

wherein said attachment element and said fitment body are configured to allow said attachment element to pivot about a notional axis extending in a height-wise direction of said front panel while being loosely received and removably held in said recess of said fitment body;

wherein said fitment body has a fixing portion having said fixing location and a receiving portion having said recess, said fixing portion configured to be releasably connected to said receiving portion;

wherein said fixing device has a main body with a grip element to be actuated manually, said grip element being configured to fix said attachment element in a locking relationship to said rear wall in an arresting position, and said grip element being configured to release said attachment element from said rear wall in a release position; and wherein said grip element is mounted pivotably relative to said main body so as to pivot between the release position and the arresting position.

11. The drawer according to claim 10, wherein said grip element is mounted pivotably about an axis extending substantially perpendicular to said height-wise direction of said front panel.

* * * * *